US007228758B2

(12) United States Patent
Fujiwara

(10) Patent No.: US 7,228,758 B2
(45) Date of Patent: Jun. 12, 2007

(54) PEDAL REACTION FORCE DEVICE

(75) Inventor: Noboru Fujiwara, Toyota (JP)

(73) Assignee: Toyoda Iron Works Co., Ltd., Toyota-shi, Aichi-ken (JP)

( * ) Notice: Subject to any disclaimer, the term of this patent is extended or adjusted under 35 U.S.C. 154(b) by 256 days.

(21) Appl. No.: 10/777,105

(22) Filed: Feb. 13, 2004

(65) Prior Publication Data

US 2005/0172753 A1 Aug. 11, 2005

(30) Foreign Application Priority Data

Feb. 9, 2004 (JP) ..... 2004-031565

(51) Int. Cl.
*G05G 1/14* (2006.01)
*F15H 53/00* (2006.01)

(52) U.S. Cl. ..... 74/512; 74/560; 74/567; 74/569

(58) Field of Classification Search ..... 74/512, 74/516, 518, 560, 567, 569; 192/99 S; 91/369.2; *G05G 7/04; B60T 7/06*
See application file for complete search history.

(56) References Cited

U.S. PATENT DOCUMENTS

| | | | | |
|---|---|---|---|---|
| 3,646,831 | A * | 3/1972 | Janosi | 74/518 |
| 3,678,779 | A * | 7/1972 | Janosi | 74/516 |
| 3,798,995 | A * | 3/1974 | Schroter | 74/512 |
| 6,367,886 | B1 | 4/2002 | Shaw | |
| 6,679,366 | B2 * | 1/2004 | Tulaczko et al. | 192/99 S |
| 2005/0145057 | A1 * | 7/2005 | Fujiwara | 74/512 |
| 2005/0235820 | A1 * | 10/2005 | Fujiwara et al. | 91/369.2 |

FOREIGN PATENT DOCUMENTS

| | | | |
|---|---|---|---|
| DE | 100 39 670 | A1 | 3/2002 |
| EP | 0 708 006 | A1 | 4/1966 |
| EP | 0 608 155 | A1 * | 7/1994 |
| EP | 0 771 705 | A1 | 8/1996 |
| EP | 0 768 224 | A1 | 4/1997 |
| EP | 0 919 903 | A1 | 6/1999 |
| FR | 2 835 798 | A1 | 2/2002 |
| JP | 8-239020 | * | 9/1996 |
| JP | 11-189131 | * | 7/1999 |
| JP | 2001-247020 | | 9/2001 |
| JP | 2002-308084 | | 10/2002 |
| JP | 2003-127846 | | 5/2003 |
| JP | 2003-261015 | | 9/2003 |

OTHER PUBLICATIONS

PTO-06-4483, English Translation of Publication No. EP 00 919 903 A1, May 2006.*
Fluid—Wikipedia, the free encyclopedia, http://en.wikipedia.org/wiki/Fluid, Dec. 4, 2006.*
European Search Report dated Aug. 12, 2005.

* cited by examiner

*Primary Examiner*—Vinh T. Luong
(74) *Attorney, Agent, or Firm*—Finnegan, Henderson, Farabow, Garrett & Dunner, LLP

(57) ABSTRACT

In a pedal reaction force device, a pedaling reaction force is applied to an operating pedal on the basis of a displacement magnitude and a variation speed of the displacement magnitude by a damper device and a spring member which are mechanically displaced in accordance with a pedaling operation of the operating pedal. The variation pattern of the displacement magnitude, that is, variation characteristics of the pedaling reaction force, are mechanically set by a cam.

10 Claims, 4 Drawing Sheets

CASE WHERE DAMPER DEVICE OR SPRING MEMBER IS PROVIDED

CASE WHERE DAMPER DEVICE AND SPRING MEMBER ARE PROVIDED

CASE WHERE SPRING MEMBER AND CAM ARE PROVIDED

PEDAL REACTION FORCE DEVICE

This application is based on Japanese Patent Application No. 2004-031565 filed Feb. 9, 2004, the contents of which are incorporated hereinto by reference.

BACKGROUND OF THE INVENTION

1. Field of the Invention

The present invention relates to improvements of a pedal reaction force device that electrically detects a pedaling stroke of an operating pedal and applies a pedaling reaction force to an operating pedal for actuating a hydraulic brake, etc.

2. Discussion of Related Art

An electric pedal device which detects a pedaling stroke of an operating pedal and causes a hydraulic device or an electric motor to execute a prescribed operation has been proposed for a normal brake pedal device for a vehicle. In such an electric brake pedal device, since only a reaction force brought about by a return spring operates and almost no reaction force is produced, there was a problem in that it was difficult for a driver, who is accustomed to a conventional mechanical type pedal device, to carry out a pedaling operation. Therefore, Patent Document 1 proposed a pedal reaction force device for applying a pedaling reaction force having non-linear hysteresis by using a plurality of spring members and dampers, and Patent Document 2 proposed a technology of applying a pedal reaction force by a spring member and simultaneously varying a variation pattern of a pedaling reaction force by electrically detecting vehicle conditions such as a pedaling speed, etc., and displacing the position of a spring retainer by an electric motor.

[Patent Document 1]Japanese Published Unexamined Patent Application No. 2003-261015

[Patent Document 2] Japanese Published Unexamined Patent Application No. 2002-308084

DISCLOSURE OF THE INVENTION

However, in the case of the above-mentioned Patent Document 1, since the reaction force characteristics depend on the spring reaction, it is difficult to apply reaction force characteristics close to a conventional mechanical type pedal device, and at the same time, since it is necessary to employ a number of spring members (three or more spring members), there is another problem in that the mechanism is complicated and large-sized, and the production cost is increased. In the case of the above-mentioned Patent Document 2, since the vehicle conditions are electrically detected and the pedaling reaction force is varied by an electric motor, etc., there is a high degree of freedom in setting the reaction force characteristics and reaction force characteristics close to the conventional mechanical type pedal device can be applied. However, there is still another problem in that a sensor and a drive device are required and increase the production cost, and simultaneously there is yet another problem in that, where an operating pedal is quickly stepped on for sudden braking (that is, during fast pedaling), a sufficient response cannot be obtained, the operation feeling is not satisfactory. If the position (the initial deformation volume of the spring member) of the spring retainer is set so as to generate a large pedaling reaction force in the initial state in order to improve the operation feeling during fast pedaling, the amount of adjustment of the spring retainer position, which is carried out by a drive device when a normal pedaling operation or a slow pedaling operation is carried out, is increased. Therefore, there is a fear that an excessive pedaling reaction force over the requirement is generated due to a delay in response, where no fundamental solution is achieved.

SUMMARY OF THE INVENTION

The present invention was developed in view of the above-described situations, and it is therefore an object of the invention to provide a simple and inexpensive pedal reaction force device which is capable of easily setting reaction force characteristics close to conventional mechanical type pedal devices.

The above object may be achieved according to a first aspect of this invention, which provides a pedal reaction force device for applying a prescribed reaction force to an operating pedal to be depressed by pedaling, comprising (a) a reaction force generating unit for applying a pedaling reaction force to the operating pedal on the basis of displacement due to the operating pedal being mechanically displaced in accordance with a pedaling operation; and (b) a displacement characteristics regulating mechanism disposed between the reaction force generating unit and the operating pedal, which transmits the reaction force to the operating pedal and simultaneously mechanically sets a variation pattern of displacement magnitude of the reaction force generating unit with respect to a pedaling stroke of the operating pedal.

With a pedal reaction force device according to the first aspect of the invention, a pedaling reaction force is applied to an operating pedal on the basis of displacement by a reaction force generating unit which is mechanically displaced in accordance with a pedaling operation of the operating pedal, and simultaneously, a variation pattern of the displacement magnitude of the reaction force generating unit, that is, the characteristics (reaction force characteristics) for varying the pedaling reaction force are mechanically set by a displacement characteristics regulating mechanism. Therefore, a higher degree of freedom in setting the reaction force characteristics can be obtained in comparison with a case where the pedaling reaction force is non-linearly varied by using a number of spring members, and it is possible to easily apply reaction force characteristics close to those of a conventional mechanical type pedal device. However, a more excellent response can be obtained together with a more inexpensive structure in comparison with a case where reaction force characteristics are electrically varied by using a sensor or a drive device.

In a first preferred form of the pedal reaction force device according to the invention, (a) the reaction force generating unit comprises (a-1) a damper device for applying a pedaling reaction force to the operating pedal on the basis of circulation resistance of a fluid by being mechanically compressed or tensioned in accordance with a pedaling operation of the operating pedal; and (a-2) a spring member for applying a pedaling reaction force to the operating pedal on the basis of resilient deformation by being mechanically and resiliently deformed in accordance with a pedaling operation of the operating pedal; (b) wherein the displacement characteristics regulating mechanism intervenes between the damper device and/or the spring member and the operating pedal.

With the first preferred form of the pedal reaction force device according to the invention, a damper device for applying a pedaling reaction force to an operating pedal on the basis of circulation resistance of a fluid and a spring member for applying a pedaling reaction force to the operating pedal on the basis of resilient deformation are provided as a reaction force generating unit. Although the pedaling reaction force is mechanically applied by the damper device and spring member, the pedaling reaction force brought about by the damper device differs, depending on pedaling speeds, wherein a greater pedaling reaction force is mechanically applied in fast pedaling than in slow pedaling, and hysteresis in which a reaction force in a pedaling operation differs from that in a returning operation is mechanically applied. Therefore, it is possible to easily obtain reaction force characteristics close to a conventional mechanical type pedal device in different pedaling speeds or in a returning operation.

In a second referred form of the pedal reaction force device according to the invention, (a) the spring member is a coil spring that is substantially concentrically disposed at the outer circumferential side of the damper device so as to surround the damper device and is compressed and tensioned in an integrated manner with the damper device in accordance with a pedaling operation of the operating pedal, and (b) a variation pattern of displacement magnitude of the spring member and the damper device is defined by a single displacement characteristics regulating mechanism.

With the second referred form of the pedal reaction force device according to the invention, since the spring member is a coil spring substantially concentrically disposed at the outer circumferential side of the damper device so as to surround the damper device and is devised so as to be displaced in accordance with a prescribed variation pattern in an integrated manner with the damper device by a single displacement characteristics regulating mechanism, the device is further simplified and constructed to be further compact in comparison with a case where separate displacement characteristics regulating mechanisms are provided with respect to the damper device and spring member, wherein excellent mounting efficiency thereof in a vehicle can be obtained.

In a third referred form of the pedal reaction force device according to the invention, (a) the operating pedal is turned around a substantially horizontal support shaft by a pedaling operation, (b) the displacement characteristics regulating mechanism is a cam whose dimension from the support shaft is continuously varied and which is turned around the support shaft in an integrated manner with the operating pedal, and (c) the reaction force generating unit is engaged with the cam and is displaced in accordance with a variation pattern corresponding to a profile of a cam surface.

With the third referred form of the pedal reaction force device according to the invention, since a cam is employed as the displacement characteristics regulating mechanism, a further higher degree of freedom in the variation pattern of the displacement magnitude, that is, in the reaction force characteristics can be achieved, optional non-linear reaction force characteristics can be set by cam profile.

In a fourth preferred form of the pedal reaction force device according to the invention, (a) the operating pedal is turned around a substantially horizontal support shaft by a pedaling operation, and (b) the displacement characteristics regulating mechanism comprises (b-1) a rocking lever which is pivotally disposed around a rocking shaft parallel to the support shaft and is connected to the reaction force generating unit; and (b-2) an interlocking mechanism which is disposed over both the rocking lever and the operating pedal and mechanically displaces the reaction force generating unit in a prescribed variation pattern by rocking the rocking lever in response to the pedaling stroke of the operating pedal.

With the fourth preferred form of the pedal reaction force device according to the invention, since the position of a rocking shaft and length of a rocking lever, connection position of the rocking lever and reaction force generating unit, and connection position of the rocking lever and operating pedal by an interlocking mechanism can be appropriately set, it is possible to freely set the variation pattern of the displacement magnitude, that is, the reaction force characteristics.

A pedal reaction force device according to the invention may be preferably used for an electric pedal device such as a normal brake pedal device, an accelerator pedal device and a parking brake pedal device for a vehicle. In particular, the pedal reaction force device may be preferably applied to an electric pedal device, while a large pedaling reaction force operates, in a conventional mechanical type pedal device, such as a hydraulic type normal brake pedal device.

An electric pedal device is constructed so as to control the output such as a braking force by electrically detecting, for example, a pedaling stroke of an operating pedal. However, it is also possible to control the output by detecting other physical quantities which vary in accordance with a pedaling operation such as an operating force (pedaling force) of an operating pedal. The operating pedal is pivotally disposed, for example, around a substantially horizontal support shaft. However, various modes of making, for example, linear movement and parallel movement are available.

It is preferable that a reaction force generating unit for applying a pedaling reaction force is constructed to be provided with a damper device and a spring member as in the second aspect of the invention. However, various means may be employed, wherein the reaction force generating unit may be constructed of any one of the damper device and the spring member, a pedaling reaction force may be applied by a magnetic force or a friction force, and a pedaling reaction force may be applied by pressing the operating pedal in a direction opposite to the pedaling direction or limiting the movement (pivotal movement) in the pedaling direction.

The damper device is such that a pedaling reaction force is applied by circulation resistance of a fluid circulating in an orifice, etc. A gas type may be preferably employed, in which a gas such as, for example, air is sealed. Other types in which liquid such as working oil and other fluid is sealed may be also employed. A check valve which interrupts circulation of a fluid when carrying out a pedaling operation of an operating pedal and permits the fluid to circulate when the operating pedal returns is provided, and great circulation resistance is generated by the above-mentioned orifice when carrying out a pedaling operation. However, it is preferable that the circulation resistance is low when the pedal returns, and the operating pedal is quickly returned to its original position by a spring member, etc.

A compression coil spring and a tensile coil spring may be preferably used as the spring member. However, other spring members such as a torsional coil spring, etc., may be employed. Further, a gas pressure type spring member such as an air spring may be used. The spring member may be concurrently used as a return spring, and it may be disposed separately from the return spring.

Where the reaction force generating unit is constructed to be provided with a plurality of members such as a spring member and a damper device, a displacement characteristics regulating mechanism is disposed for the respective members, wherein the displacement magnitudes thereof may be varied with respectively different variation patterns or with the same variation pattern. However, a displacement characteristics regulating mechanism is provided for only any one of a plurality of members to vary the displacement magnitude of a single member in accordance with a prescribed variation pattern, and, with respect to other reaction force generating units, the displacement magnitude may be varied, for example, linearly in response to a pedaling stroke of the operating pedal.

The reaction force generation unit has, for example, one end thereof fixed on a pedal bracket and the other end thereof disposed so as to be mechanically displaced with a prescribed variation pattern via the displacement characteristics regulating mechanism in accordance with a pedaling operation of the operating pedal. However, various modes are carried out, in which the one end thereof is connected to the pedal bracket so as to pivot, for example, around the axial center parallel to the support shaft.

A cam according to the third preferred form of the invention, and a rocking lever and an interlocking mechanism according to the fourth preferred form of the invention may be preferably used as the displacement characteristics regulating mechanism. However, other displacement characteristics regulating mechanisms may be employed, which are able to mechanically set and to appropriately vary a variation pattern of displacement magnitude of a reaction force generating unit with respect to a pedaling stroke of the operating pedal.

An interlocking mechanism according to the fourth preferred form of the invention is constructed by, for example, a connecting link for connecting the rocking lever and the operating pedal to each other. Also, various modes may be available, in which the rocking lever and operating pedal are connected together by a slot and a connection pin so as to turn relative to each other. With respect to the connection pattern of the rocking lever and reaction force generating unit, various modes are also available, in which, for example, a connecting link may be used or a slot and a connection pin may be used.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which:

FIG. 1*a*–1*c* are a conceptual structure view showing a pedal reaction force device to which the present invention is applied, wherein FIG. 1*a* is a plan view, FIG. 1*b* and FIG. 1*c* are front elevational views with a part thereof cut off, and FIG. 1*b* shows a state where the operating pedal is held in its original position, and FIG. 1*c* shows a state where a pedaling operation is carried out;

FIG. 2*a*–2*b* are views showing one embodiment of the invention, which is a front elevational view with apart thereof cut off, wherein FIG. 2*a* shows a state where the operating pedal is held in its original position, and FIG. 2*b* shows a state where a pedaling operation is carried out;

FIG. 3*a*–3*b* are views showing one example of variation characteristics of a pedaling reaction force according to the embodiment of the invention, wherein FIG. 3*a* shows a case of quick pedaling, and FIG. 3*b* shows a case of slow pedaling; and FIG. 4*a*–4*c* are views describing differences in variation characteristics of a pedaling reaction force in regard to the presence or absence of the damper and spring acting as a reaction force generating unit, and a displacement characteristics regulating mechanism, wherein FIG. 4*a* shows a case where the damper device or the spring member is provided, FIG. 4*b* shows a case where the damper device and the spring member are provided, and FIG. 4*c* shows a case where the spring member and the cam are provided.

DETAILED DESCRIPTION OF THE PREFERRED EMBODIMENT

Figure 1A:
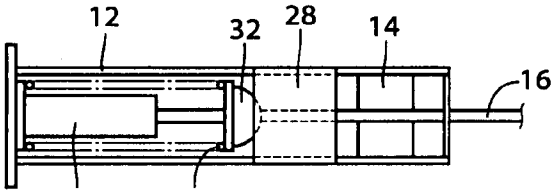
Figure 1B:
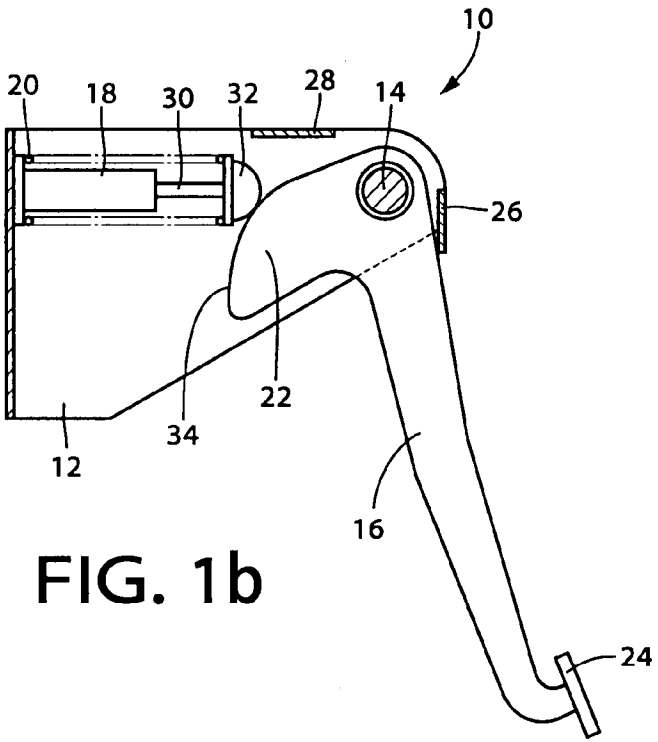
Figure 1C:
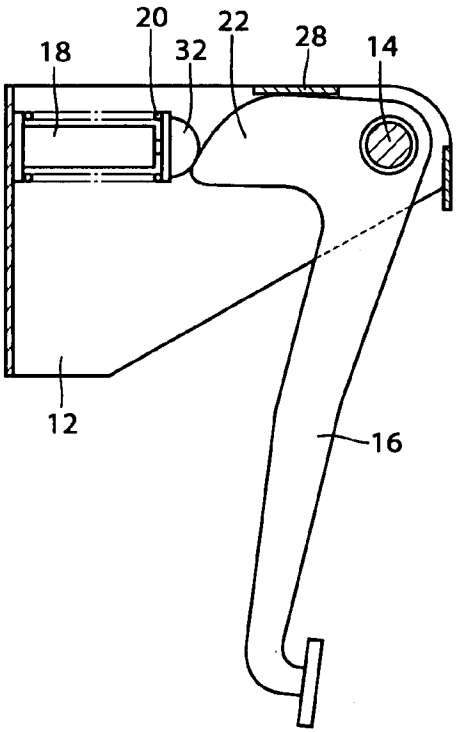

FIGS. 1*a* and 1*b* are views showing a pedal reaction force device 10 according to one embodiment of the invention. The pedal reaction force device 10 may be preferably used for, for example, an electric type normal brake pedal device for a vehicle. The pedal reaction force device 10 is provided with an operating pedal 16 pivotally disposed around the axial center of a substantially horizontal support shaft 14 secured on a bracket 12 fixed in an integrated manner with a vehicle body, a damper device 18 and a spring member 20, which operate as a reaction force generating unit, and a cam 22 acting as a displacement characteristics regulating mechanism. A depressible portion (pad) 24 is provided at the lower end part of the operating pedal 16, wherein the operating pedal 16 is turned clockwise around the support shaft 14 by a driver making a pedaling operation, and since a sensor (not illustrated) detects the pedaling stroke (a pivotal motion around the support shaft 14 and a displacement magnitude of the damper device 18), load and pressure generated at or in the depressible portion 24 and damper device 18, a braking force responsive to the detected value is generated by a hydraulic brake. FIG. 1*a* is a plan observed from above FIG. 1*b*, and FIG. 1*b* and FIG. 1*c* are front elevational views with this side of the bracket 12 cut out, wherein FIG. 1*b* shows a state where the operating pedal 16 is held in its original position before pedaling operation is carried out, and FIG. 1*c* shows a state where the pedal is in its operating state. The bracket 12 is provided in an integrated manner with an original position stopper 26 for regulating the original position of the operating pedal 16, and a limit stopper 28 for regulating the pedaling limit.

The above-mentioned damper device 18 is an air type damper for applying a pedaling reaction force to the operating pedal 16 on the basis of circulation resistance of a fluid when the damper is mechanically compressed in accordance with a pedaling operation of the operating pedal 16, and is substantially horizontally disposed in the longitudinal direction of the vehicle body at a position coincident with the operating pedal 16 in the width direction of the vehicle body. While the bottom portion of a cylinder of the damper device 18 is fixed in an integrated manner with the bracket 12, a piston rod 30 opposite to the bottom side thereof protrudes rearward of the vehicle body, that is, to the operating pedal 16 side, and a semi-spherical engagement head portion 32 secured at the tip end of the piston rod 30 is engaged with the outer circumferential surface of the cam 22, wherein the piston rod 30 is pushed into the cylinder in accordance with a pedaling operation of the operating pedal 16. A piston (not illustrated) of the damper device 18 is provided with an orifice and a check valve, and since air is circulated through the orifice when carrying out a pedal operation of the operating pedal 16 by which the piston rod 30 is pushed in, large circulation resistance is generated, and a pedaling reaction force is thereby generated in the operating pedal 16. However, since air is circulated through the check valve when the operating pedal 16 is returned, the operating pedal 16 is quickly returned to its original position by a pressing force of the spring member 20. The above-mentioned engagement head portion 32 may be made semi-columnar, presenting a semi-arcuate shape in FIGS. 1*b* and 1*c*, or a columnar turning roller may be provided instead.

The spring member 20 is mechanically resiliently deformed in accordance with a pedaling operation of the operating pedal 16 as in the above-mentioned damper device 18, and based on the resilient deformation, a pedaling reaction force is applied to the operating pedal 16. In the present embodiment, a compression coil spring may be used, which is concentrically disposed at the outer circumferential side of the damper device 18 so as to surround the damper device, and intervenes between the engagement head portion 32 and the bottom (bracket 12) of the cylinder and is compression-deformed in an integrated manner with the damper device 18 when carrying out a pedaling operation of the operating pedal 18. Based on compression deformation of the spring member 20, a pedaling reaction force is applied to the operating pedal 16, and in accordance with cancellation of the pedaling operation, the operating pedal 16 is returned to its original position in accordance with a pressing force of the spring member 20. The spring member 20 is concurrently used as the return spring.

The cam 22 intervenes between the damper device 18 and the operating pedal 16 and transmits the reaction force to the operating pedal 16, and at the same time, mechanically sets a variation pattern of displacement magnitude of the damper device 18 and spring member 20 with respect to the pedaling stroke of the operating pedal 16. The cam 22 is provided with a cam surface (outer circumferential surface) 34 whose dimensions from the support shaft 14 continuously vary. In the present embodiment, the cam 22 is secured on the base end portion of the operating pedal 16 integral thereof and is caused to turn in an integrated manner with the operating pedal around the axial center of the support shaft 14, wherein the piston rod 30 of the damper device 18 is pushed into the cylinder in accordance with the variation pattern corresponding to the profile of the cam surface 34, and simultaneously the spring member 20 is compressed and deformed with the displacement magnitude corresponding to the push-in of the piston rod 30. Therefore, the pedaling reaction force operating on the operating pedal 16 is varied with a prescribed non-linear variation pattern, wherein it is possible to easily apply reaction force characteristics close to, for example, a conventional mechanical type pedal device.

Figure 3A:
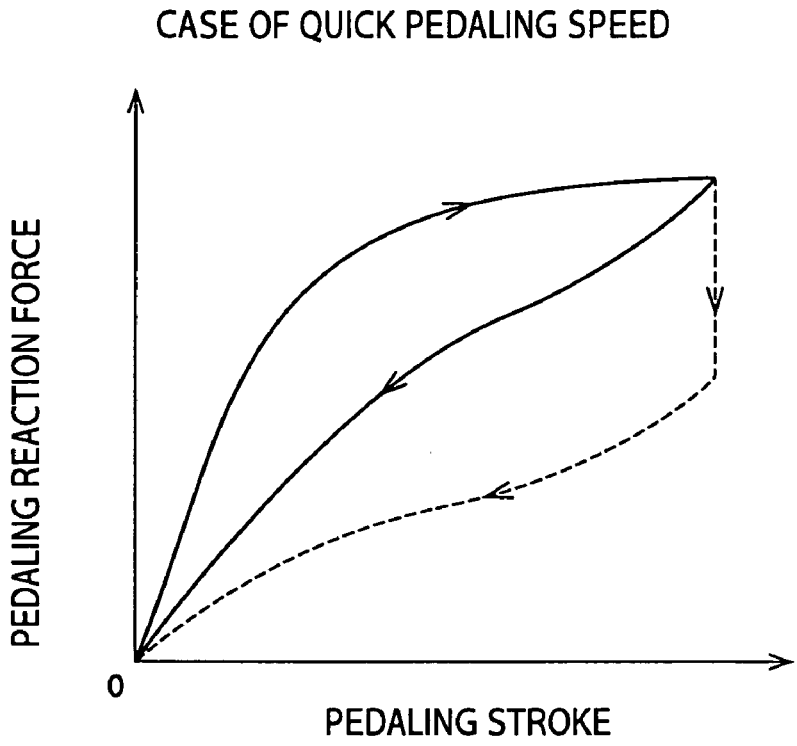
Figure 3B:
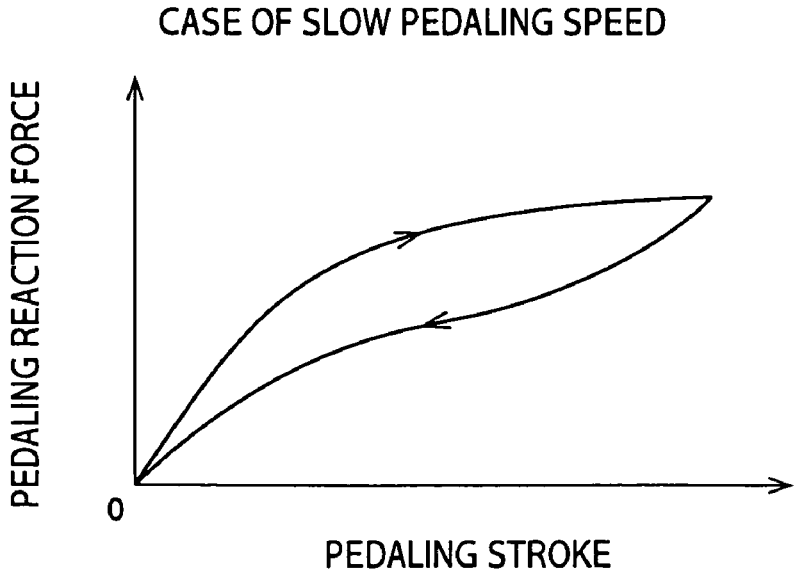

FIGS. 3*a* and 3*b* are views showing one example of variation characteristics of a pedaling reaction force of the present embodiment. The variation characteristics are non-linearly varied, corresponding to the variation pattern of displacement magnitude of the damper device 18 and spring member 20 which are varied by the above-mentioned cam 22. Also, the pedaling reaction force of the damper device 18 differs according to the pedaling speeds, wherein a greater pedaling reaction force is mechanically applied in a quick pedaling speed shown by FIG. 3*a* than in a slow pedaling speed shown by FIG. 3*b*, and hysteresis in which a reaction force in a pedaling operation differs from that in a returning operation is mechanically applied. In addition, a broken line in FIG. 3*a* expresses a case where the reaction force of the damper device 18 is lowered with a pedaled state maintained, and when a returning operation is carried out, characteristics similar to those in slow pedaling in FIG. 3*b* are shown.

Figure 4A:
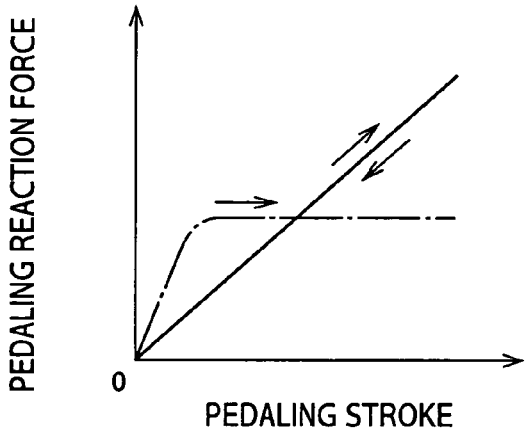
Figure 4B:
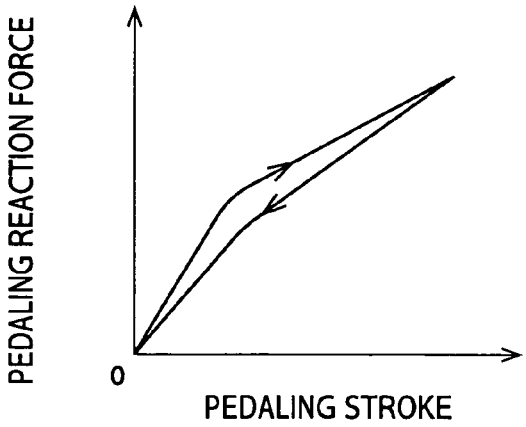
Figure 4C:
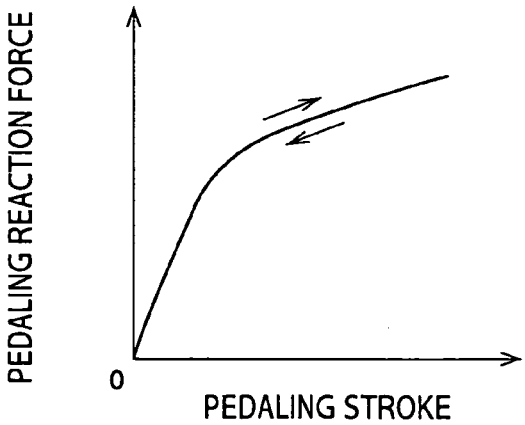

To the contrary, FIG. 4*a* shows a case where only the damper device 18 or only the spring member 20 is provided. An alternate long and short dashed line therein shows the case where only the damper device 18 is provided, since the operating pedal 16 is not returned, it is necessary to provide a return spring separate from the damper device 18. A solid line therein shows the case where only the spring member 20 is provided, wherein the pedaling reaction force is varied merely linearly. In addition, FIG. 4*b* shows a case where the damper device 18 and spring member 20 are concurrently used, wherein characteristics bent by an action of the damper device 18 are obtained. However, since basically the characteristics are linearly varied by the spring member 20, it is difficult to apply reaction force characteristics close to a conventional mechanical pedal device using, for example, a brake booster. FIG. 4*c* shows a case where the spring member 20 and cam 22 are concurrently used, wherein although non-linear reaction force characteristics close to the conventional mechanical type pedal device can be obtained by actions of the cam 22, it is impossible to vary the pedaling reaction force and to apply hysteresis in response to the pedaling speeds. Also, FIG. 4*c* corresponds to one embodiment of claim 1.

Thus, with the pedal reaction force device 10 according to the present embodiment, a pedaling reaction force is applied to the operating pedal 16 on the basis of a displacement magnitude and a variation speed of the displacement magnitude by the damper device 18 and spring member 20 which are mechanically displaced in accordance with a pedaling operation of the operating pedal 16, and the variation pattern of the displacement magnitude, that is, variation characteristics of the pedaling reaction force are mechanically set by the cam 22. Therefore, a higher degree of freedom in setting the reaction force characteristics can be obtained than in the case where the pedaling reaction force is non-linearly varied by using a number of spring members, wherein it is possible to easily apply reaction force characteristics close to a conventional mechanical type pedal device, further more excellent response performance can be obtained than in the case where the reaction force characteristics are electrically varied by using a sensor and a drive device, and construction of the pedal reaction force device 10 can be inexpensively achieved.

In addition, in the present embodiment, a damper device 18 for applying a pedaling reaction force to the operating pedal 16 on the basis of circulation resistance of a fluid and a spring member 20 for applying a pedaling reaction force to the operating pedal 16 on the basis of resilient deformation are provided as a reaction force generating unit, and a pedaling reaction force is mechanically applied by the damper device 18 and spring member 20. The pedaling reaction force brought about by the damper device 18 differs according to the pedaling speed, wherein a greater pedaling reaction force is mechanically applied in quick pedaling than in slow pedaling, and hysteresis in which a reaction force in a pedaling operation differs from that in a returning operation is mechanically applied. Therefore, reaction force characteristics close to a conventional mechanical type pedal device can be easily obtained both in a case where the pedaling speeds differ from each other and in a returning operation.

Also, since the spring member 20 is a coil spring substantially concentrically disposed on the outer circumferential side of the damper device 18 so as to surround the damper device and is displaced with a prescribed variation pattern in an integrated manner with the damper device 18 by a single cam 22, the structure can be further simplified and made compact in comparison with a case where a displacement characteristics regulating mechanism such as a cam 22 is separately provided with respect to the damper device 18 and spring member 20, wherein excellent mounting efficiency in a vehicle body can be obtained. In particular, the dimensions thereof in the width direction (the vertical direction in FIG. 1*a*) of the vehicle body can be constructed to be compact.

Also, since the cam 22 is used as the displacement characteristics regulating mechanism, a degree of freedom in setting a variation pattern of displacement magnitude, that is, the characteristics of the pedaling reaction force is made still higher, and it is possible to freely set optional non-linear variation characteristics by the cam profile of the cam surface 34.

Figure 2B:
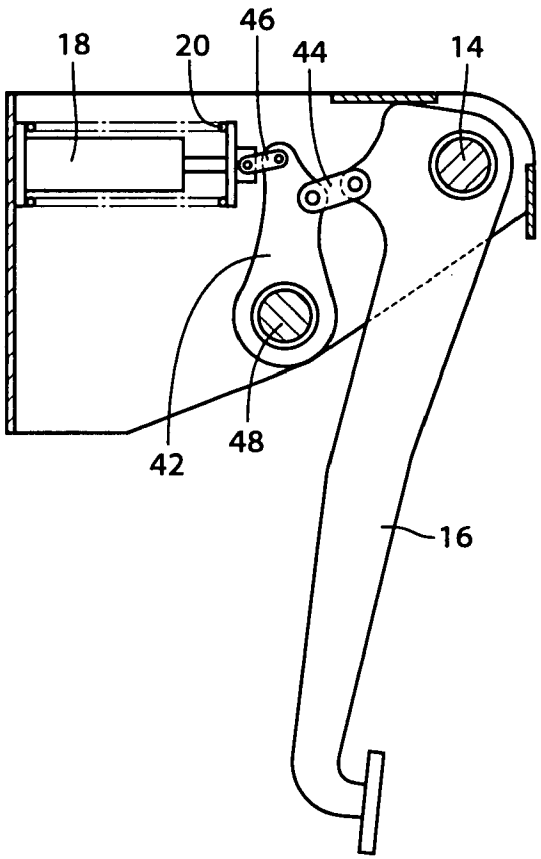
Figure 2A:
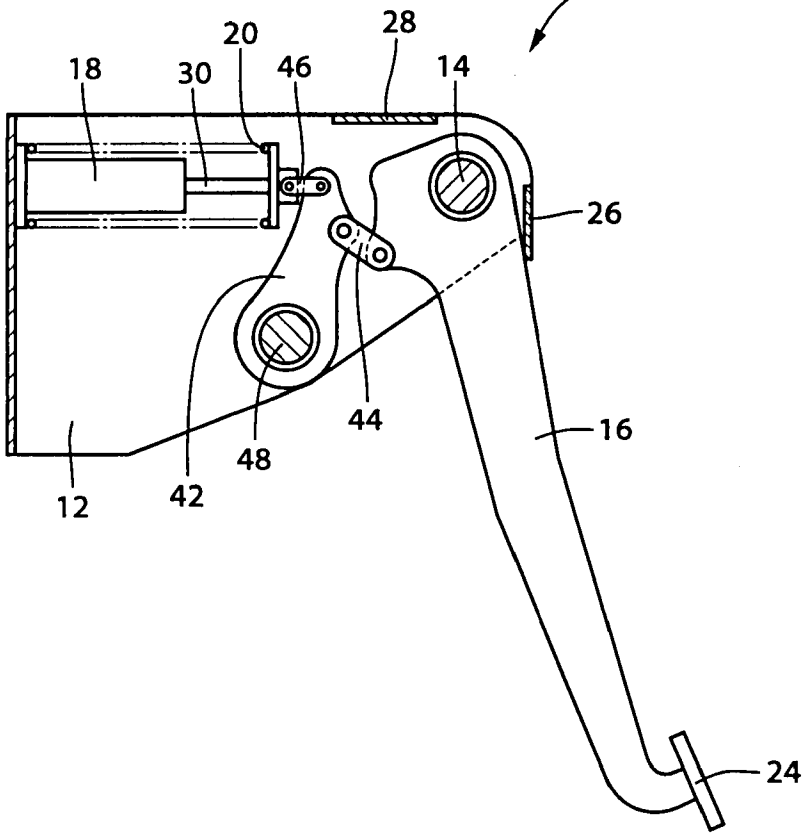

In addition, although the cam 22 is used as the displacement characteristics regulating mechanism in the above-mentioned embodiment, it is possible to vary the displacement magnitude of a piston rod 30 with respect to a pedaling stroke of the operating pedal 16 on the basis of a prescribed variation pattern by using a rocking lever 42 and a pair of connecting links 44 and 46 as in the pedal reaction force device 40 shown in FIGS. 2*a* and 2*b*. The rocking lever 42 is pivotally disposed around the axial center of the rocking shaft 48 parallel to the support shaft 14, and simultaneously is connected to the operating pedal 16 and piston rod 30 via the connecting links 44 and 46 so as to be pivotable relatively around a connection pin parallel to the support shaft 14, respectively. The piston rod 30 is displaced in response to a pedaling operation of the operating pedal 16 in accordance with a prescribed variation pattern which is determined by the length dimensions of the rocking lever 42 and connecting links 44 and 46, and connected positions thereof, wherein effects similar to those of the above-mentioned embodiment can be obtained.

In addition, the connecting link 44 corresponds to an interlocking mechanism, and composes the displacement characteristics regulating mechanism along with the rocking lever 42. In addition, FIGS. 2*a* and 2*b* are views corresponding to FIGS. 1*b* and 1*c*, which are front elevational views with this side of the bracket 12 cut off, wherein FIG. 2*a* shows a state where the operating pedal 16 is held in its original position, and FIG. 2*b* shows a state where a pedaling operation is carried out.

As described above, one embodiment of the invention was described in detail by reference to the drawings. The embodiment is merely one mode of the invention, and the invention can be embodied in various modifications and improvements on the basis of those skilled in the art.

The invention claimed is:

1. A pedal reaction force device for applying a prescribed reaction force to an operating pedal to be depressed by pedaling, comprising:

a reaction force generating unit for applying a pedaling reaction force to said operating pedal on the basis of displacement due to said operating pedal being mechanically displaced in accordance with a pedaling operation;

a displacement characteristics regulating mechanism disposed between said reaction force generating unit and said operating pedal, which transmits said reaction force to said operating pedal, and simultaneously mechanically non-linearly sets a variation pattern of displacement magnitude of said reaction force generating unit with respect to a pedaling stroke of said operating pedal;

said reaction force generating unit comprising:

(i) a damper device for applying the pedaling reaction force to said operating pedal on the basis of circulation resistance of a fluid sealed in said damper device by being mechanically compressed or tensioned in accordance with the pedaling operation of the operating pedal;

(ii) a spring member for applying the pedaling reaction force to said operating pedal on the basis of resilient deformation by being mechanically and resiliently deformed in accordance with the pedaling operation of said operating pedal, the pedaling reaction force of the damper device differing according to the pedaling; and the spring member being a coil spring substantially concentrically disposed radially outward of the damper device so as to surround the damper device and being compressed and tensioned integral with the damper device in accordance with the pedaling operation of the operating pedal.

2. A pedal reaction force device according to claim 1, wherein said displacement characteristics regulating mechanism intervenes between said damper device and said spring member and said operating pedal.

3. The pedal reaction force device according to claim 2, wherein a variation pattern of displacement magnitude of said spring member and said damper device is defined by a single displacement characteristics regulating mechanism.

4. The pedal reaction force device according to claim 3, wherein said operating pedal is turned around a substantially horizontal support shaft by the pedaling operation, said displacement characteristics regulating mechanism is a cam whose dimension from said support shaft is continuously varied and which is turned around said support shaft in an integrated manner with said operating pedal, and said reaction force generating unit is engaged with said cam and is displaced in accordance with the variation pattern corresponding to a profile of a cam surface.

5. The pedal reaction force device according to claim 3, wherein said operating pedal is turned around a substantially horizontal support shaft by a pedaling operation, and said displacement characteristics regulating mechanism comprises a rocking lever which is pivotally disposed around a rocking shaft parallel to said support shaft and is connected to said reaction force generating unit; and an interlocking mechanism which is disposed over both said rocking lever and said operating pedal and mechanically displaces said reaction force generating unit in a prescribed variation pattern by rocking said rocking lever in response to the pedaling stroke of said operating pedal.

6. The pedal reaction force device according to claim 2, wherein said operating pedal is turned around a substantially horizontal support shaft by the pedaling operation, said displacement characteristics regulating mechanism is a cam whose dimension from said support shaft is continuously varied and which is turned around said support shaft in an integrated manner with said operating pedal, and said reaction force generating unit is engaged with said cam and is displaced in accordance with a variation pattern corresponding to a profile of a cam surface.

7. The pedal reaction force device according to claim 2, wherein said operating pedal is turned around a substantially horizontal support shaft by a pedaling operation, and said displacement characteristics regulating mechanism comprises a rocking lever which is pivotally disposed around a rocking shaft parallel to said support shaft and is connected to said reaction force generating unit; and an interlocking mechanism which is disposed over both said rocking lever and said operating pedal and mechanically displaces said reaction force generating unit in a prescribed variation pattern by rocking said rocking lever in response to the pedaling stroke of said operating pedal.

8. The pedal reaction force device according to claim 1, wherein said operating pedal is turned around a substantially horizontal support shaft by the pedaling operation, said displacement characteristics regulating mechanism is a cam whose dimension from said support shaft is continuously varied and which is turned around said support shaft in an integrated manner with said operating pedal, and said reaction force generating unit is engaged with said cam and is displaced in accordance with a variation pattern corresponding to a profile of a cam surface.

9. The pedal reaction force device according to claim 1, wherein said operating pedal is turned around a substantially horizontal support shaft by a pedaling operation, and said displacement characteristics regulating mechanism comprises a rocking lever which is pivotally disposed around a rocking shaft parallel to said support shaft and is connected to said reaction force generating unit; and an interlocking mechanism which is disposed over both said rocking lever and said operating pedal and mechanically displaces said reaction force generating unit in a prescribed variation pattern by rocking said rocking lever in response to the pedaling stroke of said operating pedal.

10. The pedal reaction force device according to claim 1, wherein the pedal reaction force device is applied to an electric pedal device.

* * * * *

UNITED STATES PATENT AND TRADEMARK OFFICE

CERTIFICATE OF CORRECTION

PATENT NO. : 7,228,758 B2
APPLICATION NO. : 10/777105
DATED : June 12, 2007
INVENTOR(S) : Noboru Fujiwara It is certified that error appears in the above-identified patent and that said Letters Patent is hereby corrected as shown below:

Claim 1, col. 10, line 11, “pedaling; and” should read --pedaling speed; and--.

Signed and Sealed this

Twenty-third Day of October, 2007

JON W. DUDAS
*Director of the United States Patent and Trademark Office*